US007318293B2

(12) United States Patent
Ardern, II

(10) Patent No.: US 7,318,293 B2
(45) Date of Patent: Jan. 15, 2008

(54) BINDER CLIP SLEEVE

(76) Inventor: William B. Ardern, II, 9948 N. Lakeshore Dr., Mequon, WI (US) 53092

( * ) Notice: Subject to any disclaimer, the term of this patent is extended or adjusted under 35 U.S.C. 154(b) by 0 days.

(21) Appl. No.: 10/664,634

(22) Filed: Sep. 19, 2003

(65) Prior Publication Data

US 2005/0060923 A1 Mar. 24, 2005

(51) Int. Cl.
*G09F 3/16* (2006.01)

(52) U.S. Cl. ..... 40/666; 40/299.01; 40/638; 40/641; 40/658; 24/67.5

(58) Field of Classification Search ..... 40/299.01, 40/359, 360, 625, 626, 630, 638, 641, 652, 40/658, 666, 322, 316; 24/67.3, 67.5, 67.9; 223/85; 283/41, 36
See application file for complete search history.

(56) References Cited

U.S. PATENT DOCUMENTS

| | | | | | |
|---|---|---|---|---|---|
| 211,050 | A | | 12/1878 | Reynolds | |
| 913,876 | A | | 3/1909 | Cohen | |
| 1,133,388 | A | | 3/1915 | Merrill | |
| 1,139,627 | A | | 5/1915 | Baltzley | |
| 1,232,747 | A | * | 7/1917 | Yochim | 40/360 |
| 1,484,413 | A | * | 2/1924 | Roberge | 40/652 |
| 1,569,986 | A | | 1/1926 | Kurtzeborn | |
| 1,857,934 | A | | 5/1932 | Blackburn | |
| 2,166,916 | A | | 7/1939 | Lombard | |
| 2,586,931 | A | | 2/1952 | Gammon | |
| 2,690,624 | A | * | 10/1954 | Phillips | 40/652 |
| 2,704,216 | A | | 3/1955 | Slonneger | |
| 3,225,469 | A | | 12/1965 | Chase | |
| 3,286,381 | A | | 11/1966 | Wooge | |
| 3,287,690 | A | | 11/1966 | Book | |
| 3,290,810 | A | * | 12/1966 | Morena | 40/641 |
| 3,335,467 | A | * | 8/1967 | Freed | 40/658 |
| D224,406 | S | | 7/1972 | Heck | |
| 4,011,673 | A | * | 3/1977 | Levine | 40/641 |
| 4,261,121 | A | * | 4/1981 | Coon | 40/332 |
| 4,286,358 | A | * | 9/1981 | Levin | 24/67 R |
| 4,332,060 | A | | 6/1982 | Sato | |
| 4,532,680 | A | | 8/1985 | Hashimoto | |

(Continued)

FOREIGN PATENT DOCUMENTS

| | | |
|---|---|---|
| GB | 2356171 | 11/1999 |

(Continued)

OTHER PUBLICATIONS

Smead Viewables, Amazon.com website, http://www.amazon.com/gp/product/B00006ICLY/103-9053221-3607838?v=glance&n=1064954, Aug. 29, 2002.*

(Continued)

*Primary Examiner*—Gary C. Hoge
(74) *Attorney, Agent, or Firm*—Jansson Shupe & Munger Ltd.

(57) ABSTRACT

A binder clip sleeve for securing indicia to a binder clip and a method of securing the indicia to the binder clip. The binder clip sleeve comprises three panels which generally conform to outer surfaces of the binder clip. Indicia may be displayed along one or more of the three panels.

32 Claims, 4 Drawing Sheets

U.S. PATENT DOCUMENTS

| | | | | |
|---|---|---|---|---|
| 4,761,862 | A | 8/1988 | Hiromori | |
| 4,802,263 | A | 2/1989 | Lorber | |
| 4,991,806 | A | 2/1991 | Nakamura et al. | |
| D321,209 | S | 10/1991 | Hiromori | |
| D321,210 | S | 10/1991 | Hiromori | |
| 5,199,140 | A | 4/1993 | Valiulis et al. | |
| 5,249,336 | A | 10/1993 | Miller | |
| 5,309,605 | A | 5/1994 | Sato | |
| 5,441,182 | A * | 8/1995 | Sullivan | 223/85 |
| 5,455,410 | A | 10/1995 | Schneider | |
| 5,513,459 | A | 5/1996 | Schneider | |
| 5,522,586 | A * | 6/1996 | Bennett et al. | 270/8 |
| 5,533,236 | A | 7/1996 | Tseng | |
| D372,498 | S | 8/1996 | Sato | |
| 5,579,907 | A | 12/1996 | Kedski | |
| 5,619,789 | A | 4/1997 | Chung | |
| 5,624,095 | A | 4/1997 | Zissu | |
| 5,638,583 | A | 6/1997 | Tseng | |
| D381,361 | S | 7/1997 | Sato | |
| D384,106 | S | 9/1997 | Shinya | |
| 5,695,219 | A | 12/1997 | Crawford | |
| 5,766,795 | A * | 6/1998 | Will et al. | 429/167 |
| 5,806,147 | A * | 9/1998 | Sato | 24/67.9 |
| 5,836,098 | A | 11/1998 | Carney | |
| 5,839,215 | A * | 11/1998 | Lasprogata | 40/299.01 |
| 5,896,624 | A | 4/1999 | Horswell | |
| 5,937,485 | A | 8/1999 | Dittmer | |
| 5,950,283 | A | 9/1999 | Sato | |
| 6,065,884 | A | 5/2000 | Parker et al. | |
| D430,892 | S | 9/2000 | Kulik | |
| 6,141,894 | A | 11/2000 | Thalenfeld et al. | |
| 6,237,263 | B1 | 5/2001 | Hagstrom et al. | |
| 6,327,749 | B1 * | 12/2001 | Antinone | 24/67 R |
| 6,363,941 | B1 | 4/2002 | Combs | |
| 6,374,463 | B1 | 4/2002 | Kaufman | |
| D468,355 | S | 1/2003 | Danella et al. | |
| 6,553,702 | B1 | 4/2003 | Bacnik | |
| D479,146 | S | 9/2003 | Manley | |
| D485,780 | S | 1/2004 | Thomson | |
| 6,732,419 | B2 | 5/2004 | Davis | |
| 2001/0032376 | A1 | 10/2001 | Payne | |
| 2002/0134299 | A1 | 9/2002 | Chua | |
| 2003/0034611 | A1 | 2/2003 | Lacy | |

FOREIGN PATENT DOCUMENTS

| | | |
|---|---|---|
| GB | 2356172 | 11/1999 |
| WO | WO98/24638 | 6/1998 |

OTHER PUBLICATIONS

Avery White Mailing Labels Box top and bottom panels and specimen label sheeet, Copyright 2002 (3 pages).
Keysan on-line catalog excerpts <www.keysan.com>, Date: Feb. 13, 2003.
S.A. Promotions on-line catalog excerpts, Date: Feb. 17, 2003.
Crestline on-line catalog excerpt <www.crestline.com>, Date: Feb. 19, 2003.
Avien Stationary on-line catalog excerpt <www.avien-stationary.com>, Date: Feb. 13, 2003.
Promotional Business magazine. Date: Sep. 2006.
2006 Lasting Impressions Catalog, Lee Wayne Corporation. pp. 42 and 44.
4imprint Catalog. Date: Fall 2006. pp. 15 and 22.
National Pen Company Catalog. Date: Fall 2006. p. 55.
Smead Viewables Color Labeling System (4 pages). Date: Unknown.

* cited by examiner

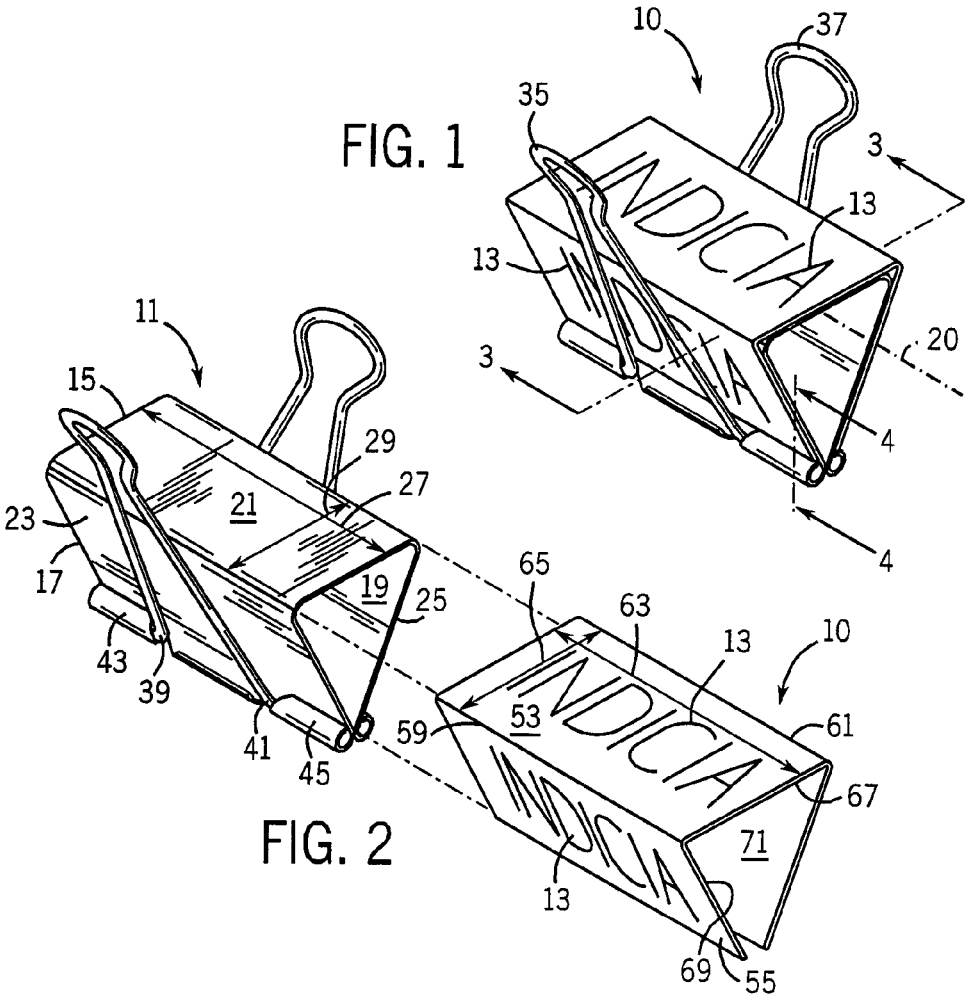
FIG. 1
FIG. 2
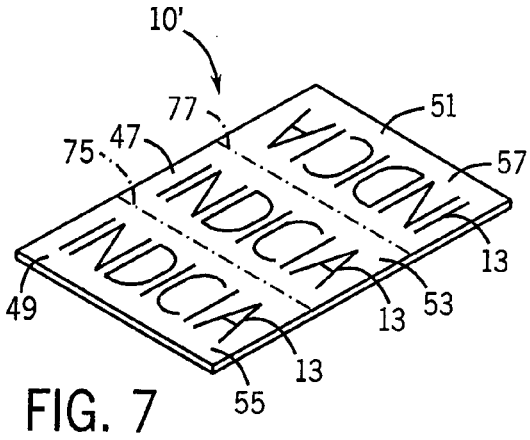
FIG. 7
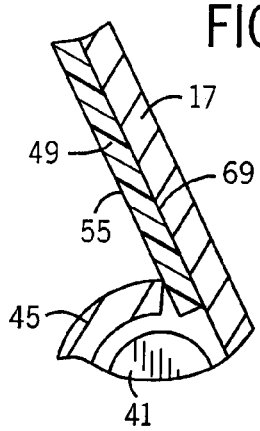
FIG. 4

BINDER CLIP SLEEVE

BACKGROUND OF THE INVENTION

1. Field of the Invention

This invention is related generally to indicia-bearing devices and, more particularly, to apparatus and methods adapted to associate indicia with a binder clip.

2. Description of Related Art

Binder clips are well known in the art. Binder clips are essentially clamping devices which are used to grip a single object or to hold together plural objects, such as paper sheets.

Binder clips typically comprise a body including a pair of resilient jaw portions and a spine portion. The spine portion is located between the jaw portions and connects the jaw portions. The width of the spine portion typically determines the maximum thickness of the object or objects which may be gripped by the binder clip. The body is commonly formed by folding a unitary metal blank. In such embodiments, the body serves as a spring urging each jaw portion toward the other to clamp or grip the object or objects therebetween. A pair of handles are typically provided. One handle is attached to each jaw portion. Displacement of the handles toward each other results in opening of the jaw portions to receive an object or release the object. As is known, binder clips are provided in a range of sizes permitting selection of the binder clip best suited to the size of the object or objects to be gripped.

Binder clips are available from numerous commercial sources, two of which are Acco Brands, Inc. of Lincolnshire, Ill. and Keysan of Pittsburgh, Pa. Binder clips are not limited to a single design as examples of binder clip design variations have been proposed, for example, in U.S. Pat. No. 4,802,263 (Lorber), U.S. Pat. No. 5,896,624 (Horswell) and U.S. Pat. Nos. 5,309,605, 5,806,147 and D372,498 all to Sato.

One limitation of commercially-available binder clips is that such binder clips are underutilized as a productivity improvement and communication tool. This problem stems from the fact that binder clips typically look alike, each having a black monochromatic appearance. The very sameness of such binder clips precludes the use of such clips as a document-identification tool or as a communication platform. And, while quite useful, such binder clips are not particularly aesthetically pleasing.

Efforts have been made to improve the utility of binder clips by associating indicia with such clips. The indicia serve to distinguish one binder clip from another thereby allowing the binder clip to serve as a document-identification tool. For example, one approach has been to secure a tag or title card to the clip body by means of mechanical fasteners as shown in U.S. Pat. No. 1,133,388 (Merrill) and U.S. Pat. No. 1,139,627 (Baltzley). Another approach, exemplified by U.S. Pat. No. 3,286,381 (Wooge) and patent publication no. US 2001/0032376 (Payne) involves the use of an upright index tab secured to the clip body. A still further approach has been to provide identification caps or sleeves over the ends of the handles as discussed in U.S. Pat. No. 4,532,680 (Hashimoto), U.S. Pat. No. 4,761,862 (Hiromori) and U.S. Pat. No. 5,249,336 (Miller). Binder clips have also been modified to hold indicia-bearing objects, such as the scorecards described in U.S. Pat. No. 1,857,934 (Blackburn).

However, all of these attempts to improve the utility of binder clips have certain disadvantages. For example, specific manufacturing steps are required to make the mechanical fasteners used to secure identification tags or cards to the binder clip. The mechanical ears securing the tag or card could cause injury to the user and the tag or card could become detached from the binder clip. The upright index tab may interfere with handling of documents gripped by the binder clip or could inconveniently interfere with closure of a file drawer containing the clipped-together documents. And, such upright index tab could break off, for example when clipped-together documents are forcefully placed in a person's briefcase.

Regarding the identification caps or sleeves, such caps or sleeves may interfere with handling of the binder clip and clipped documents when the binder clip handles are in their gripping position. On the other hand, if the binder clip handles are folded against the surface of the clipped object then the caps or sleeves might not be visible, particularly if the clipped documents are in a file between abutting documents.

It would be a significant improvement in the art to provide a binder clip sleeve which would serve to optimize the utility of binder clips, which would permit use of the binder clip as a productivity tool and communication platform without interfering with handling of documents and things g ripped by the binder clip, which would present an opportunity to make the binder clip more aesthetically pleasing and which would be simple and economical to manufacture and use.

SUMMARY OF THE INVENTION

The invention is directed to a sleeve adapted to be secured to a binder clip. The term "sleeve" is defined herein as a part adapted to be fit over and around another part. For purposes of the invention, the part over which the sleeve is fitted is the binder clip. Unlike a tube, the sleeve of the invention is discontinuous so as to permit the sleeve to be placed over and around the binder clip without interfering with placement of the binder clip jaw portions over an object or objects to be gripped by the binder clip.

The inventive sleeve advantageously permits a near limitless range of graphic and text indicia to be quickly and easily associated with the binder clip. By way of example only, such indicia may include text or graphic information, raised or indented elements (e.g., braille characters), designs, artwork, photographs, textures, etc. The indicia-bearing clip has significant utility across a broad range of productivity-enhancement and communication applications. Such applications include use of the binder clip as an advertising platform, as a document-organizing tool or for use as an information-displaying, productivity-enhancement tool. For example, the indicia-bearing sleeve can function like a file folder serving to identify a group of related documents thereby making document identification and selection easier and more efficient. The inventive sleeve may also be used simply to make the appearance of the standard binder clip more aesthetically pleasing.

The sleeve advantageously provides increased area for location of indicia and permits improved viewing of the indicia from plural sides of the clipped documents. Fewer and less complex components are required and such components do not interfere with handling of clipped documents. The inventive sleeve is adapted for use with commercially-available, unmodified binder clips and is rugged and simple to manufacture.

In general, preferred forms of the binder clip sleeve include a tri-panel binder clip sleeve which is adapted to secure indicia to a binder clip. The binder clip comprises a body with first and second resilient jaw portions, a connecting spine portion therebetween and an outer surface along each of the jaw and spine portions. As is known, the binder clip includes a handle secured to each of the jaw portions. Pressing together of the handles separates the jaw portions permitting an object or objects to gripped by the binder clip.

Preferably, the tri-panel binder clip sleeve comprises first, second and third panels. Each panel is preferably configured and arranged to overlie, respectively, the jaw and spine portions of the binder clip. Each of the three panels of the binder clip sleeve have an outwardly-facing surface on which indicia may be located and displayed.

The binder clip sleeve may have alternative embodiments, three of which are presented herein. In one embodiment, the binder clip sleeve is preferably made of a self-supporting material. The preferred binder clip sleeve has a tri-panel configuration adapted to be fitted over some or all of the corresponding portions of the binder clip. The binder clip sleeve may be held in engagement with the binder clip, for example, by frictional engagement between the sleeve and binder clip or by means of a suitable adhesive.

In a further preferred binder clip sleeve embodiment, the binder clip sleeve may be in the form of a foldable adhesive-backed substrate which may be affixed to the binder clip. Such foldable adhesive-backed binder clip sleeve embodiment may be provided in the form of a sheet including plural binder clip sleeves formed therein. The sheet may be printed or marked, for example with a laser or ink-jet printer, so that the indicia are affixed to the plural binder clip sleeves in a form selected by the user.

In yet another embodiment, the binder clip sleeve may be in the form of a plural component device comprising a substrate sleeve element in combination with a light-transmissive sleeve. The substrate sleeve element and light-transmissive sleeve are preferably adapted to have a tri-panel structure permitting the substrate sleeve element and light-transmissive sleeve element to cover some or all of the outer surface of the binder clip. It is highly preferred that the light-transmissive sleeve element is adapted to hold the substrate sleeve element in place against the binder clip by means of frictional engagement. Indicia on the substrate sleeve preferably are viewable through the light-transmissive sleeve element.

The invention includes a method of affixing indicia to the binder clip. In general, the method includes the steps of affixing indicia to a tri-panel binder clip sleeve and affixing the tri-panel binder clip sleeve to the binder clip. The binder clip sleeve may be sized for a friction fit with the binder clip and may be affixed to the binder clip by sliding the binder clip sleeve over the binder clip. The binder clip sleeve may also be affixed to the binder clip by means of adhesive. In a further step, a light-transmissive sleeve element may be placed over the binder clip sleeve.

Further details regarding the invention are set forth in the drawings and detailed descriptions which follow.

BRIEF DESCRIPTION OF THE DRAWINGS

The drawings illustrate preferred embodiments which include the above-noted characteristics and features of the invention. In the drawings:

FIG. 1 is a perspective view of one exemplary binder clip sleeve embodiment in accordance with this invention. The exemplary binder clip sleeve is shown in engagement with a binder clip.

FIG. 2 is a further perspective view of the exemplary binder clip sleeve embodiment of FIG. 1, but positioned out of engagement with the binder clip.

FIG. 4 is an enlarged partial view of the exemplary binder clip sleeve of FIG. 1 in engagement with the binder clip taken along section line 4—4 of FIG. 1.

FIG. 7 is a further perspective view of the binder clip sleeve embodiment of FIG. 5 shown apart from the binder clip.

DETAILED DESCRIPTION OF PREFERRED EMBODIMENTS

The binder clip sleeve and the method of use of such binder clip sleeve will now be described in conjunction with binder clip sleeve embodiments 10, 10' and 10". Each of binder clip sleeves 10, 10' and 10" are provided to secure a wide range of indicia 13 to a binder clip, such as binder clip 11. As will be apparent, the binder clip sleeves 10, 10' and 10" share components and features which are the same or similar. For purposes of brevity and simplicity, like reference numbers will be used to describe and identify such components and features.

Figure 3:
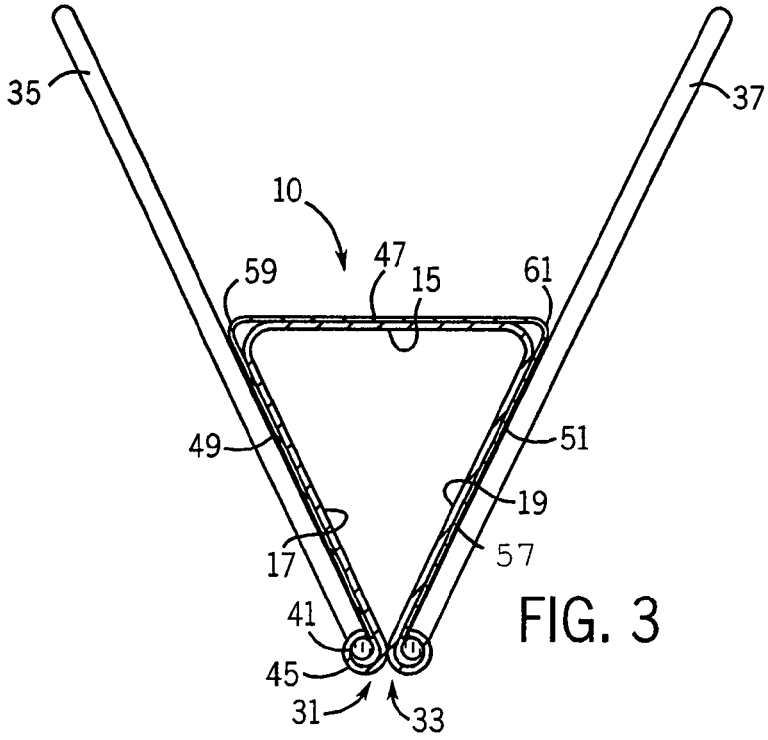
FIG. 3 is a sectional view of the exemplary binder clip sleeve in engagement with the binder clip taken along section line 3—3 of FIG. 1.

An exemplary binder clip 11 will first be described in connection with FIGS. 1 through 6 and 10. The binder clip 11 shown includes a spine 15, first and second resilient jaw portions 17, 19 and axis 20. Spine 15 connects first and second resilient jaw portions 17, 19. The spine 15 and jaw portions 17, 19 preferably have respective outer surfaces 21, 23 and 25 each of which has an area generally defined by respective length and width dimensions, such as the length 27 and width 29 dimensions along spine 15 surface 21 shown in FIG. 2. The first and second resilient jaw portions 17, 19 are inclined resiliently inward toward the other such that jaw portion ends 31, 33 abut or closely abut one another. As best shown in FIG. 3, the binder clip 11 typically has an appearance generally like that of an isosceles triangle when viewed along a section transverse to axis 20 as indicated by section line 3—3 of FIG. 1. The binder clip 11 is typically formed of a resilient material, such as spring metal, so that the jaw portions 17, 19 will be urged to the position shown in FIGS. 1–3, 5 and 10.

Handles 35 and 37 are provided to enable a user to spread apart the jaw portion ends 31, 33 and jaw portions 17, 19 so that the binder clip 11 can be positioned to grip one or more papers or articles (not shown) between jaw portions 17, 19 as is well known in the art. Each handle 35, 37 is secured to a respective jaw portion 17, 19 by engagement of two handle end portions, two of which 39, 41 are indicated in FIG. 2, each with a respective tube-shaped receiving portion, two of which 43, 45 are indicated, also in FIG. 2. The unshown end portions of handle 37 and the tube-shaped receiving portions along jaw portion 19 are mirror images, respectively, of end portions 39, 41 of handle 35 and tube-shaped receiving portions 43, 45.

The binder clip 11 described and shown in connection with FIGS. 1–6 and 10 is conventional. Illustrative binder clips 11, include model numbers 72010, 72020, 72050, and 72100 binder clips available from Acco Brands, Inc. of Lincolnshire, Ill. The binder clip 11 suitable for use with the binder clip sleeve 10, 10' and 10" of the invention is not limited to the specific configuration shown in FIGS. 1–6 and 10 and may have dimensions other than as shown in FIGS. 1–6 and 10. For example, jaw portions 17, 19 may have surfaces 23, 25 which have length and width dimensions (such as dimensions 27, 29) other than those shown in FIGS. 1–6 and 10. Moreover, it is not necessary for surfaces 21, 23 and 25 to be continuous as shown in FIGS. 1–6 and 10. Spine 15 and jaw portions 17, 19 need not be planar.

FIGS. 1–4 show a first binder clip sleeve 10 embodiment suitable for use in securing indicia 13 to binder clip sleeve 11. Preferred embodiments of binder clip sleeve 10 may be characterized as a "tri-panel" sleeve because the binder clip sleeve 10 is provided with three panels 47, 49, 51 each of which have an outwardly-facing surface 53, 55 and 57. Panels 49 and 51 are not joined together thereby permitting binder clip jaw portion ends 31, 33 to receive an object or objects therebetween for gripping by the jaw portions 17, 19. Indicia 13 are preferably displayed on some or all of respective surfaces 53, 55 and/or 57.

Panel 47, corresponding the binder clip spine 15, and panel 49, corresponding to one jaw portion 17 are separated by transition portion 59 while panel 47 and panel 51, corresponding to a jaw portion 17 or 19 are separated by transition portion 61' (FIG. 3). Transition portions 59, 61 may have any suitable profile. For example, transition portions 59, 61 may each form a radius between respective panels 47 and 49 and 47 and 51 or may comprise an edge surface formed in sleeve 10.

In the binder clip sleeve 10 embodiment shown in FIGS. 1–4, the panels 47, 49 and 51 are further defined by length and width dimensions, such as the length 63 and width 65 shown defining panel 47. The length and width dimensions 63, 65 of panels 47, 49 and 51 may be selected such that the area of panels 47, 49 and 51 approximates the area of the corresponding spine 15 and jaw portions 17, 19 of the binder clip 11 and are essentially congruous with such spine 15 and jaw portions 17, 19. Sizing of panels 47, 49 and 51 to approximate the areas of spine 15 and jaw 17, 19 portions maximizes the available surface portions 53, 57 and 59 for placement of indicia 13.

In the binder clip sleeve 10 embodiment shown in FIGS. 1–4, binder clip sleeve 10 is placed over binder clip 11 such that the surfaces 53, 55 and 57 bearing indicia 13 are viewable. As best shown in FIGS. 1–4, the panels 47, 49 and 51 are preferably configured and arranged such that the binder clip sleeve 10 is held in place against the binder clip 11 by frictional engagement of some or all of the binder clip sleeve 10 inwardly-facing surfaces 67, 69 and 71 with the corresponding spine 15 and jaw portions 17, 19. Preferably, the friction fit between binder clip sleeve 10 and binder clip 11 is such that the binder clip sleeve 10 may be slid over the binder clip 11 while not sliding off of the binder clip 11 in actual use. Such an arrangement would permit a user to grasp the binder clip sleeve 10 with her fingers and to slide the binder clip sleeve 10 onto the binder clip 11 without need for the use of tools.

An adhesive (not shown) may be optionally be provided on one or more of inwardly-facing surfaces 67, 69, 71 to hold sleeve 10 in engagement with binder clip 11. If provided, such adhesive would have the general appearance of adhesive 73 shown in FIG. 6 in conjunction with binder clip sleeve embodiment 10'. The optional adhesive may be pre-applied to binder clip sleeve 10 and a removable release liner (not shown) affixed to the adhesive. The removable release liner could be removed before placing the binder clip sleeve 10 over the binder clip 11.

Indicia 13 may be applied directly to one or more of panels 47, 49 and 51, such as by printing, silk screening, painting, embossing, impressing, forming or any other suitable means. Indicia 13 could be secured to panels 47, 49 and 51 by adhesive or other suitable securement means, such as by heat transfer. The indicia 13 could comprise any suitable type of matter, including without limitation, text, human or machine-readable code, images or design elements.

Referring further to FIGS. 1–4, exemplary binder clip sleeve 10 is preferably a unitary member. A one-piece binder clip sleeve 10 would have the advantage of being less expensive to manufacture than a binder clip sleeve made of plural joined-together portions. However, persons of skill in the art will recognize that a suitable binder clip sleeve 10 could be made of two or more joined-together portions.

Binder clip sleeve 10 may be made of any suitable material. For binder clip sleeves 10 configured to be held in place against the binder clip, such sleeves 10 should be sufficiently rigid to remain in place against the binder clip 11. The binder clip sleeve 10 of such embodiment is preferably made of a self-supporting material and generally has the form of an isosceles triangle in a section along section line 3—3 as shown, particularly in FIGS. 1–3. The material selected for use in making binder clip sleeve 10 should also be able to flex as the binder clip 11 jaw portions 17, 19 are opened to receive papers or other objects therebetween and are then closed over the paper or objects. Representative materials include plastic, brass and aluminum.

Plastic is a desirable material for use in making binder clip sleeve 10 because plastic is a low-cost material and typically readily accepts indicia 13 by conventional means, such as by printing. The plastic material used to make binder clip sleeve 10 is preferably extruded to essentially correspond to the shape of the binder clip 11 in the closed position shown in FIGS. 1–3. A wide range of plastic materials may be used. Acrylonitrile butadiene styrene (ABS), acrylic, polyethylene, melamine, polyvinyl chloride (PVC), styrene, vinyl, LEXAN® and the like are suitable materials. Such plastic materials preferably have a thickness in the range of about 0.010 inch to about 0.020 inch.

Other suitable materials for use in making binder clip sleeve 10 are Type C260 brass shim stock, half hard, cold rolled and Type 5052-H32 aluminum shim stock. Such metal-based materials preferably have a thickness in the range of from about 0.005 inch to about 0.008 inch.

A further binder clip sleeve embodiment 10' will now be described in connection with FIGS. 5–9. Binder clip sleeve 10', like binder clip sleeve 10, is adapted to permit indicia 13 to be secured to a binder clip 11. Binder clip sleeve 10' shown in FIGS. 5–9 comprises a tri-panel sleeve including first, second and third panels 49, 51 and 47. The panels 47, 49 and 51 are configured and arranged to correspond generally to the spine 15, and jaw portions 17, 19 of binder clip 11. As with binder clip sleeve embodiment 10, panels 49 and 51 are separated thereby permitting binder clip jaw portion ends 31, 33 to receive an object or objects therebetween for gripping by the jaw portions 17, 19. Each of panels 47, 49 and 51 has a corresponding inwardly-facing surface 67, 69 and 71.

Figure 6:
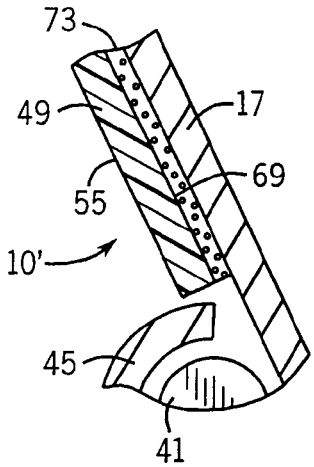
FIG. 6 is an enlarged partial view of the exemplary binder clip sleeve of FIG. 5 in engagement with the binder clip taken along section line 6—6 of FIG. 5.

An adhesive 73 is located on at least portions of the inwardly-facing surfaces 69, 71 of panels 49, 51 (FIG. 6). Adhesive 73 may also be positioned on inwardly-facing surface 67 of the panel 47 corresponding to binder clip spine portion 15. Adhesive 73 secures binder clip sleeve 10' in engagement with the binder clip 11.

Figure 5:
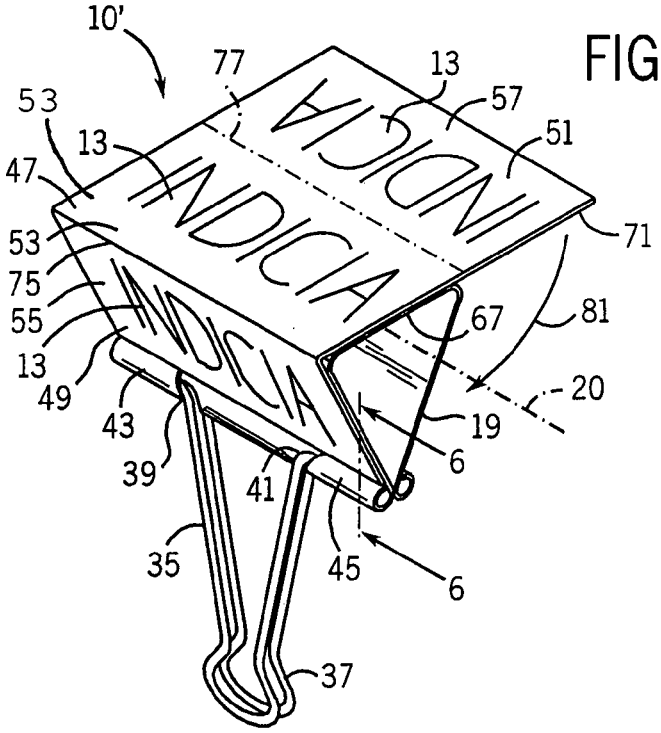
FIG. 5 is a perspective view of a further exemplary binder clip sleeve embodiment in accordance with this invention. The exemplary binder clip sleeve is shown in partial engagement with a binder clip.

As is well shown in FIG. 5, binder clip sleeve 10' comprises a foldable substrate made of a foldable material. Representative materials may include paper, mylar, poyethylene film and the like. To facilitate conformation of the binder clip sleeve 10' to the binder clip 11, a transition portion in the form of a fold line 75 is provided between panels 47, 49 and a further transition portion, also in the form of fold line 77 is provided between panels 47 and 51.

As shown in FIG. 5, panels 47 and 49 have been secured, respectively, to the binder clip spine 15 and jaw portions 17 and panel 51 is being folded along fold line 77 in the direction of arrow 81 such that inwardly-facing surface 71 of panel 51 is brought into contact with and is secured to jaw portion 19. Separately, or as part of transition portion fold lines 75, 77, perforations (not shown) may be included to further facilitate folding of the panels 47–51 and uniform engagement of the panels 47–51 with corresponding spine 15 and jaw portions 17, 19 of binder clip 11.

The panels 47–51 of binder clip sleeve 10' of FIGS. 5–9 are further defined by length and width dimensions (not shown), such as the length 63 and width 65 dimensions defining panel 47 in FIG. 2. Such length and width dimensions of panels 47, 49 and 51 of binder clip sleeve 10' may be selected such that the area of panels 47, 49 and 51 approximates the area of the corresponding spine 15 and jaw portions 17, 19 of the binder clip 11 and are essentially congruous with such spine 15 and jaw portions 17, 19 thereby maximizing the area available for indicia 13.

Figure 8:
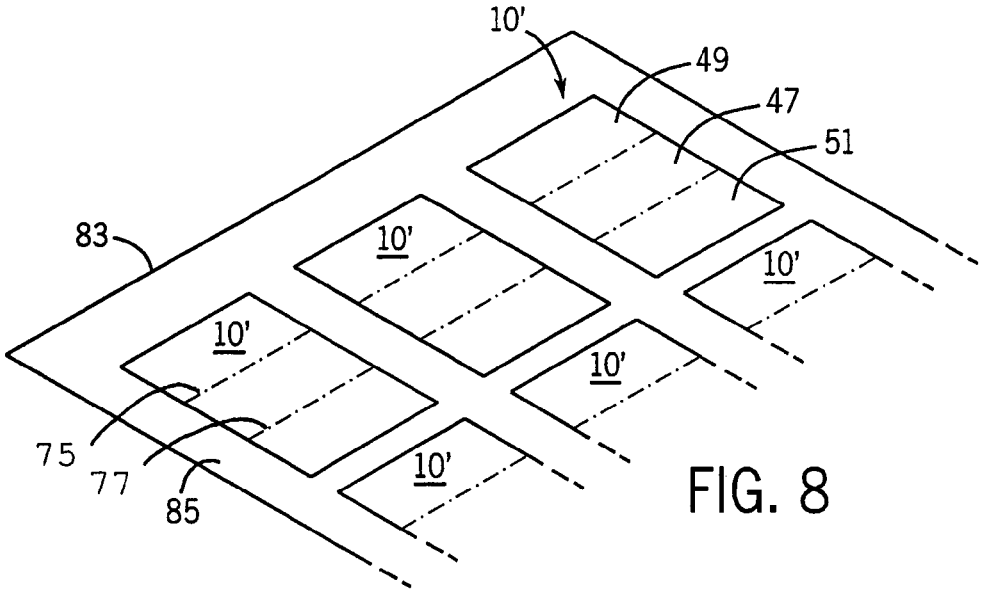
FIG. 8 is a perspective view of a sheet including plural pre-formed binder clip sleeves of the type illustrated in FIG. 5.
Figure 9:
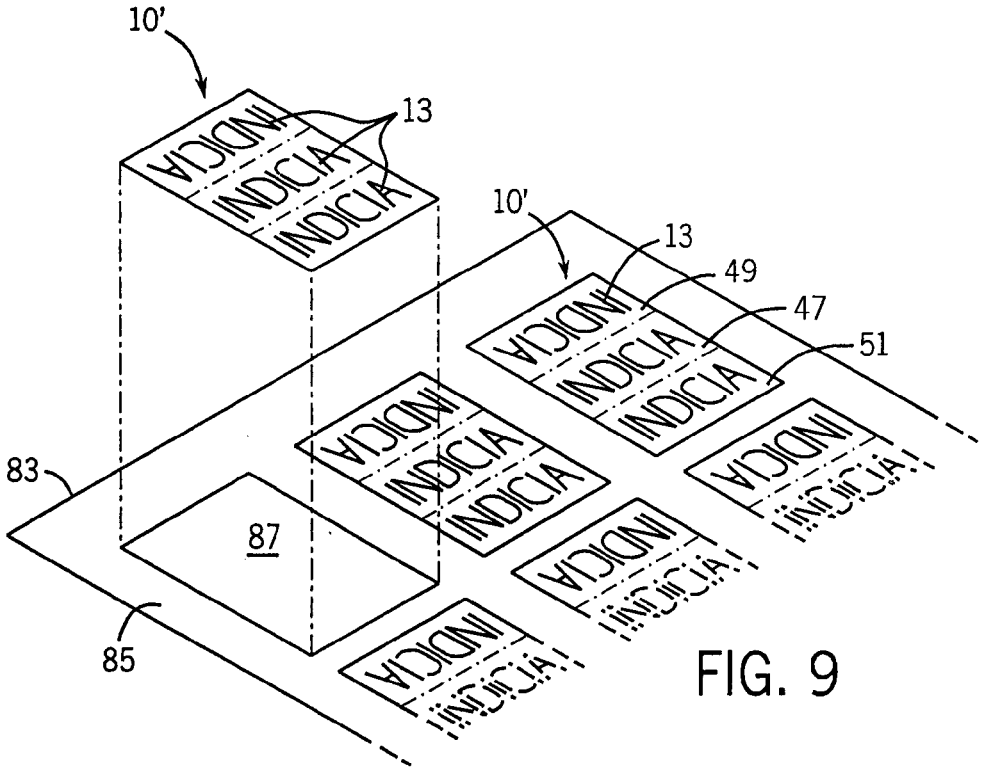
FIG. 9 is a perspective view of the sheet of FIG. 8 but after application of indicia to the binder clip sleeves.

As shown in FIGS. 7–9, binder clip sleeve 10' may be provided in the form of a sheet 83 in which plural binder clip sleeves 10' are formed. Sheet 83 includes an adhesive-backed substrate portion 85 which preferably includes plural binder clip sleeves 10' formed therein. The binder clip sleeves 10' may be formed in substrate portion 85 by die cutting or by any other suitable forming means. Substrate portion 85 is removably attached to a release liner 87. This arrangement permits one or more of the plural binder clip sleeves 10' to be "peeled off" sheet 83 for attachment to a binder clip 11. Sheet 83 may be sized to be compatible with a suitable printer, such as a computer-driven printer. Exemplary computer-driven printers may include a Hewlett-Packard™ LaserJet 4L printer or an Epson™ C80 ink jet printer. The computer driving the printer may include a software program provided to format indicia 13 for printing on one or more of panel surfaces 53, 55, 57. This arrangement permits a user to readily print indicia 13 of the user's choosing on some or all of the binder clip sleeves 10' as shown in FIG. 9. Of course, indicia 13 may be located on the plural binder clip sleeves 10' in other suitable manners. There is no particular limitation with respect to the type of device used to place the indicia 13 on the panel surfaces 53, 55, 57.

Figure 10:
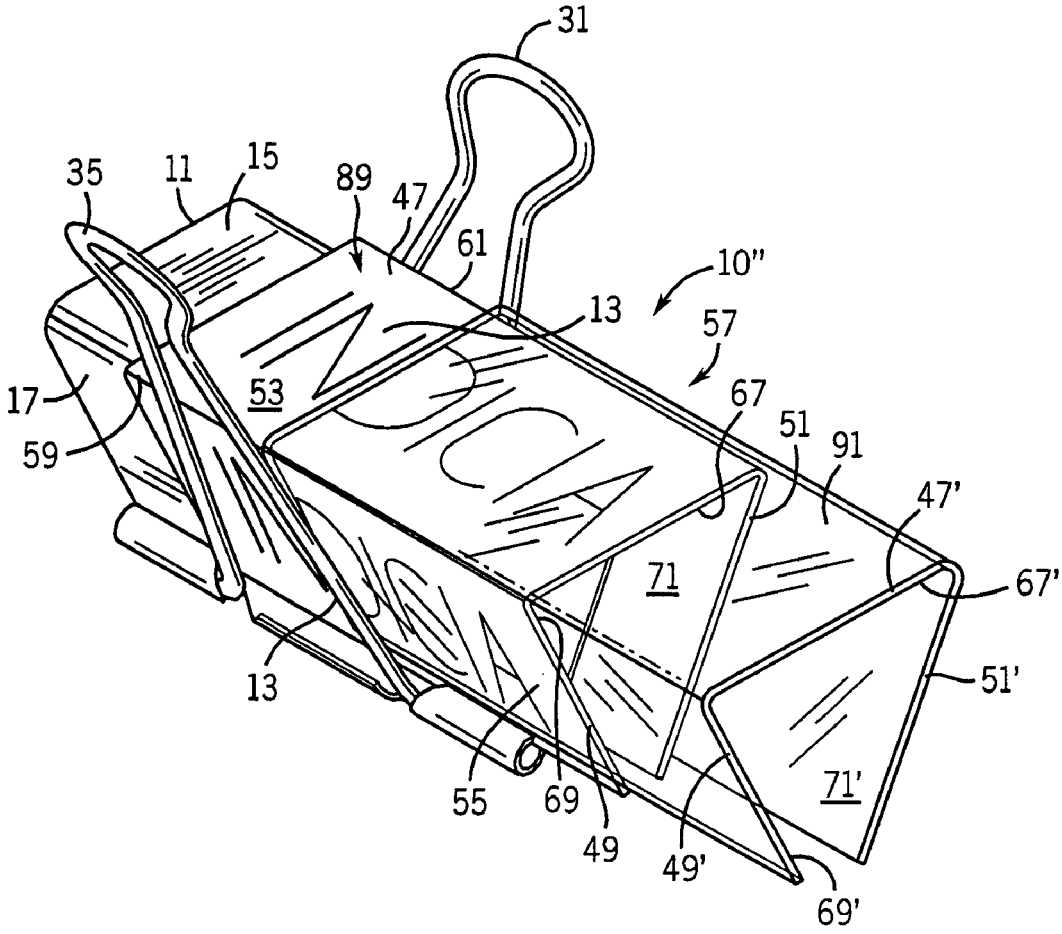
FIG. 10 is a perspective view of another exemplary binder clip sleeve embodiment in accordance with this invention. The binder clip sleeve shown includes an exemplary tri-panel sleeve substrate in combination with a light-transmissive sleeve element fitted over the substrate. The substrate and light-transmissive sleeve element shown in FIG. 10 are shown partially apart from the binder clip.

Yet another binder clip sleeve according to the invention is shown in FIG. 10. The binder clip sleeve 10" embodiment shown in FIG. 10 comprises a substrate sleeve element 89 and a light-transmissive sleeve element 91. Light-transmissive sleeve element 91 is preferably adapted to fit over the substrate sleeve element 89 and binder clip 11 to hold substrate sleeve element 89 in place against the binder clip 11 by means of a friction fit. The substrate and light-transmissive sleeve elements 89, 91 are shown in partial engagement with binder clip 11 in FIG. 10 to assist the reader in understanding the relative placement of elements 89, 91 with respect to each other and binder clip 11. In use, substrate sleeve element 89 and light-transmissive sleeve element 91 are co-aligned over binder clip 11.

As with embodiments 10 and 10', binder clip sleeve 10" substrate sleeve element 89 is provided to display indicia 13 along one or all of first, second and third panels 49, 51 and 47. The panels 47, 49 and 51 are configured and arranged to correspond generally to the spine 15, and jaw portions 17, 19 of binder clip 11. Each of panels 47, 49 and 51 has a corresponding outwardly-facing surface 53, 55 and 57 on which indicia 13 may be located. Inwardly-facing surfaces 67, 69 and 71 face respective panels 15, 17 and 19 of the binder clip 11. A transition portion 59 is provided between panels 47, 49 and a further transition portion 61 is provided between panels 47, 51 to facilitate conformation of the substrate sleeve element 89 with the binder clip 11.

The panels 47–51 of binder clip sleeve 10' substrate sleeve element 89 are further defined by length and width dimensions (not shown), such as the length 63 and width 65 shown defining panel 47 in FIG. 2. The length and width dimensions of panels 47, 49 and 51 may be selected such that the area of panels 47, 49 and 51 approximates the area of the corresponding spine 15 and jaw portions 17, 19 of the binder clip 11 and are essentially congruous with such spine 15 and jaw portions 17, 19. Maximizing the area of panels 47, 49 and 51 provides greater opportunities for placement of indicia 13.

Light-transmissive sleeve element 91 is provided to fit over substrate sleeve element 89. Light-transmissive sleeve element 91 includes panels 47', 49' and 51' which correspond with substrate sleeve element 89 panels 47, 49 and 51 and are preferably configured and arranged to correspond to binder clip spine 15 and jaw portions 17, 19. Light-transmissive sleeve element 91 is made of a self-supporting material which is held in place against the binder clip 11 by frictional engagement of some or all of the inwardly-facing surfaces 67', 69' and 71' with the corresponding spine 15 and jaw portions 17, 19. Such engagement may hold substrate sleeve element 89 in place against binder clip 11. Preferably, the friction fit between light-transmissive sleeve element 91 and binder clip 11 is such that the element 91 may be slid over the binder clip 11 while not sliding off of the binder clip 11 in actual use. Such an arrangement permits a user to place the substrate 89 against the binder clip 11 and to grasp the light-transmissive sleeve element 91 with his fingers and to manually slide such element 91 onto the binder clip 11. As a result, the substrate 89 is clamped between the binder clip 11 and light-transmissive sleeve element 91.

Substrate sleeve element 89 is preferably made of a foldable material that may be conformed to the shape of the binder clip 11. Representative materials include paper, mylar, poyethylene film and the like. Indicia 13 may be located on one or all of first, second and third panels 49, 51 and 47. Adhesive (not shown) may optionally be used on some or all of surfaces 67–71 against binder clip 11. Light-transmissive sleeve element 91 is preferably made of a material such as LEXAN® brand plastic sheet available from the General Electric Company. Plastic sheet with a thickness of about 0.1 inch to about 0.3 inch has been found to be satisfactory, although other thicknesses may be utilized. Light-transmissive sleeve element 91 need not be made of a transparent material and can be of any light-transmissive material provided that indicia 13 disposed under the element 91 can be observed by a user.

It will be readily understood that the binder clip sleeves 10, 10' and 10" need not be limited to the specific tri-panel configuration shown in FIGS. 1–10 as other geometric shapes will suffice. It is intended that the binder clip sleeve 10, 10' and 10" panels 47–51 (or 47'–51') may be configured for any purpose, including for the purpose of aesthetics. Moreover, the panels 47–51 need not be continuous or generally planar as shown in FIGS. 1–10 and may include openings, protrusions and recesses of various kinds and types to suit the desires of the end user. Panels 47–51 need not overlie the entire surfaces of the respective spine 15 and jaw portions 17, 19.

The indicia 13 selected for application to, within or beneath one or more of panel surfaces 53, 55 and 57 of binder clip sleeves 10, 10' and 10" may comprise virtually any type of text or graphic matter. For binder clip sleeves 10, 10' and 10" adapted to be productivity-enhancement devices, indicia 13 could comprise text elements describing the type of materials held by the binder clip 11 or indicia 13 could simply comprise a color or color combination provided to differentiate the materials held by the binder clip from other materials. Such indicia 13 would serve much like a file folder permitting the clipped-together documents to be identified easily and rapidly and efficiently retrieved. Indicia 13 could comprise an advertisement consisting of, for example, the name, address and telephone number of a business. Indicia 13 could comprise raised braille elements or any suitable form of design, artwork, photograph or the like.

While the principles of this invention have been described in connection with specific embodiments, it should be understood clearly that these descriptions are made only by way of example and are not intended to limit the scope of the invention.

What is claimed is:

1. A tri-panel binder clip sleeve adapted to secure indicia to a binder clip, in combination with a binder clip comprising:

a binder clip having:

a spine;

first and second jaw portions connected to opposite end portions of the spine integral therewith, the jaw portions each having a tip resiliently biased into abutment withh the other tip;

an outer surface along each of the jaw portions and spine; and a handle secured to each of the jaw portions such that pressing together of the handles separates the tips; and a tri-panel binder clip sleeve attached to the binder clip having:

a first panel in overlying relationship with the first jaw portion outer surface, said first panel having an outwardly-facing surface for displaying indicia located thereon;

a second panel in overlying relationship with the second jaw portion outer surface, said second panel having an outwardly-facing surface for displaying indicia located thereon; and a third panel spaced between and connecting the first and second panels, the third panel being in overlying relationship with the spine portion and having an outwardly-facing surface for displaying indicia located thereon;

at least the first and second panels being secured to the respective jaw portion such that the tri-panel binder clip sleeve is held in place on the binder clip and the handles are uncovered by the tri-panel binder clip sleeve; and indicia on at least one of the panels.

2. The tri-panel binder clip sleeve of claim 1 wherein:

the jaw and spine portion outer surfaces each have an area defined by length and width dimensions; and the first, second and third panels each have an area substantially congruous with the respective jaw and spine portion outer surfaces.

3. The tri-panel binder clip sleeve of claim 1 wherein the tri-panel binder clip sleeve is a unitary member.

4. The tri-panel binder clip sleeve of claim 3 wherein the tri-panel binder clip sleeve is self-supporting.

5. The tri-panel binder clip sleeve of claim 4 wherein the first, second and third panels are sized such that the tri-panel binder clip sleeve is in frictional engagement with the binder clip.

6. The tri-panel binder clip sleeve of claim 5 wherein the tri-panel binder clip sleeve comprises a material selected from the group consisting of plastic, acrylonitrile butadiene styrene, acrylic, polyethylene, melamine, polyvinyl chloride, styrene, vinyl, LEXAN, polyethylene, brass and aluminum.

7. The tri-panel binder clip sleeve of claim 1 wherein:

the tri-panel binder clip sleeve comprises a foldable substrate;

the first, second and third panels each have an inwardly-facing surface;

an adhesive is located on at least portions of the first and second panel inwardly-facing surfaces; and the adhesive secures the tri-panel binder clip sleeve in engagement with the binder clip.

8. The tri-panel binder clip sleeve of claim 7 wherein the foldable substrate comprises paper.

9. The tri-panel binder clip sleeve of claim 7 wherein the foldable substrate is made of a material selected from the group comprising paper, mylar and poyethylene film.

10. The tri-panel binder clip sleeve of claim 7 wherein the jaw and spine portion outer surfaces each have an area defined by length and width dimensions and the foldable substrate is pre-formed such that the first, second and third panels each have an area substantially congruous with the respective jaw and spine portion outer surfaces.

11. The tri-panel binder clip sleeve of claim 10 wherein the adhesive is located on substantially all of the first, second and third panel inwardly-facing surfaces.

12. The tri-panel binder clip sleeve of claim 7 wherein the tri-panel binder clip sleeve further includes a fold line between each of the first and third and second and third panels to facilitate engagement of the panels with the binder clip.

13. The tri-panel binder clip sleeve of claim 7 wherein the tri-panel binder clip sleeve further includes a perforation line between each of the first and third and second and third panels to facilitate engagement of the panels with the binder clip.

14. The tri-panel binder clip sleeve of claim 1, further including a light-transmissive sleeve element located over the binder clip sleeve.

15. A tri-panel binder clip sleeve adapted to be secured over a binder clip, in combination with a binder clip comprising:

a binder clip including:

a spine;

first and second jaw portions connected to opposite end portions of the spine integral therewith, the jaw portions each having a tip resiliently biased into abutment with the other tip;

an outer surface along each of the jaw portions and spine; and a handle secured to each of the jaw portions such that pressing together of the handles separates the tips; and a unitary, self-supporting sleeve element including:

a first panel configured for overlying relationship with the binder clip first jaw portion outer surface, said first panel having an outwardly-facing surface for displaying indicia located thereon;

a second panel configured for overlying relationship with the binder clip second jaw portion outer surface, said second panel having an outwardly-facing surface for displaying indicia located thereon; and a third panel spaced between and connecting the first and second panels, the third panel being configured for overlying relationship with the spine portion outer surface and having an outwardly-facing surface for displaying indicia located thereon; and indicia on at least one of the panels;

said unitary, self-supporting sleeve element being structured such that the first, second and third panels each have an area substantially congruous with the respective jaw and spine portion outer surfaces, and, collectively, are configured and arranged to fit over the binder clip structure without covering the handles.

16. The tri-panel binder clip sleeve of claim 15 wherein the first, second and third panels are sized such that the tri-panel binder clip sleeve is in frictional engagement with the binder clip.

17. The tri-panel binder clip sleeve of claim 16 wherein the tri-panel binder clip sleeve comprises a material selected from the group consisting of plastic, acrylonitrile butadiene styrene, acrylic, polyethylene, melamine, polyvinyl chloride, styrene, vinyl, LEXAN, polyethylene, brass and aluminum.

18. The tri-panel binder clip sleeve of claim 15 wherein:

the first, second and third panels each have an inwardly-facing surface; and an adhesive is located on at least portions of the first, second and third panel inwardly-facing surfaces.

19. The tri-panel binder clip sleeve of claim 15 wherein the tri-panel binder clip sleeve further includes a transition portion between each of the first and third and second and third panels to facilitate engagement of the panels with the binder clip.

20. The tri-panel binder clip sleeve of claim 15 wherein the indicia are raised or indented elements proximate the panels.

21. The tri-panel binder clip sleeve of claim 15, further including a light-transmissive sleeve element located over the binder clip sleeve.

22. A method of affixing indicia to a binder clip, said binder clip having a spine portion, first and second jaw portions connected to opposite ends of the spine portion integral therewith, the jaw portions each having a tip resiliently biased into abutment with the other tip, an outer surface along each of the jaw and spine portions, and a handle and a handle secured to each of the jaw portions such that pressing together of the handles separates the tips, the method comprising:

affixing indicia directly to a tri-panel binder clip sleeve, said sleeve having first and second panels each structured to overlie one of the binder clip jaw portions, and a third panel structured to overlie the binder clip spine portion, said tri-panel binder clip sleeve being further structured such that at least the first and second panels are secured to the respective jaw portion to hold the panel binder clip sleeve in place on the binder clip without covering the handles; and affixing the tri-panel binder clip sleeve to the binder clip.

23. The method of claim 22 wherein the binder clip sleeve first, second and third panels are structured to frictionally engage the binder clip and the affixing step comprises the step of sliding the binder clip sleeve over the binder clip.

24. The method of claim 22 wherein the binder clip sleeve first, second and third panels each have an inwardly-facing surface and an adhesive located on at least a portion of the inwardly-facing surfaces and the affixing step comprises the step of adhering the binder clip sleeve to the the binder clip.

25. The method of claim 22 further including the step of placing a light-transmissive sleeve element over the binder clip sleeve.

26. A tri-panel binder clip sleeve adapted to secure indicia to a binder clip in combination with a binder clip comprising: a binder clip having: a spine portion; first and second jaw portions connected to opposite ends of the spine portion integral therewith, the jaw portions each having a tip resiliently biased into abutment with the other tip; an outer surface along each of the jaw and spine portions; and handle secured to each of the jaw portions such that pressing together of the handles separates the tips; and the tri-panel binder clip sleeve having: first, second and third panels in respective overlying relationship with the binder clip first and second jaw portions and spine portion such that at least the first and second panels are secured to the respective jaw portion to hold the tri-panel binder clip sleeve in place on the binder clip without covering the handles, each of said panels having an outwardly-facing surface capable of displaying indicia located thereon; and indicia on at least one of the panels.

27. The tri-panel binder clip sleeve of claim 26 wherein:

the jaw and spine portion outer surfaces each have an area defined by length and width dimensions; and the first, second and third panels each have an area substantially congruous with the respective jaw and spine portion outer surfaces.

28. The tri-panel binder clip sleeve of claim 26 wherein the tri-panel binder clip sleeve is a self-supporting unitary member.

29. The tri-panel binder clip sleeve of claim 28 wherein the first, second and third panels are sized such thai the tri-panel binder clip sleeve is in frictional engagement with the binder clip.

30. The tri-panel binder clip sleeve of claim 26 wherein the tri-panel binder clip sleeve comprises a foldable substrate, the first, second and third panels each have an inwardly-facing surface and an adhesive secures the tri-panel binder clip sleeve to the binder clip.

31. The tri-panel binder clip sleeve of claim 30 wherein the foldable substrate compnses paper.

32. The tri-panel binder clip sleeve of claim 30 wherein the foldable substrate is made of a material selected from the group consisting of mylar and polyethylene film.

* * * * *

UNITED STATES PATENT AND TRADEMARK OFFICE

CERTIFICATE OF CORRECTION

PATENT NO. : 7,318,293 B2
APPLICATION NO. : 10/664634
DATED : January 15, 2008
INVENTOR(S) : Ardern, II It is certified that error appears in the above-identified patent and that said Letters Patent is hereby corrected as shown below:

IN THE SPECIFICATION:

In column 2, line 18, delete “g ripped” and insert --gripped--.

In column 5, line 23, delete “61’” and insert --61--.

In column 5, line 54, after “may” delete “be”.

In column 6, line 62, delete “poyethylene” and insert --polyethylene--.

In column 8, line 34, delete “poyethylene” and insert --polyethylene--.

IN THE CLAIMS:

In column 9, line 23, claim 1, delete “withh” and insert --with--.

In column 9, line 38, claim 1, after “thereon;” delete “and”.

In column 10, line 17, claim 9, delete “poyethylene” and insert --polyethylene--.

In column 12, line 17, claim 26, after “portions; and” insert --a--.

In column 12, line 39, claim 29, delete “thai” and insert --that--.

Signed and Sealed this
Third Day of March, 2015

Michelle K. Lee

Michelle K. Lee
*Deputy Director of the United States Patent and Trademark Office*